US005437211A

United States Patent [19]

Wolfe

[11] Patent Number: 5,437,211

[45] Date of Patent: Aug. 1, 1995

[54] APPARATUS FOR EJECTING NUTS FROM SOCKETS AND A METHOD OF INSTALLATION IN A SOCKET

[75] Inventor: James P. Wolfe, Wallingford, Conn.

[73] Assignee: Innovative Achievements, Inc., Wallingford, Conn.

[21] Appl. No.: 205,167

[22] Filed: Mar. 3, 1994

[51] Int. Cl.[6] ..... B21K 5/16; B25B 13/02

[52] U.S. Cl. ..... 76/114; 81/124.1

[58] Field of Search ..... 76/114, 101.1; 81/121.1, 124.1, 125

[56] References Cited

U.S. PATENT DOCUMENTS

| | | | |
|---|---|---|---|
| 1,607,421 | 11/1926 | Work . | |
| 2,301,945 | 11/1942 | Green | 81/124.1 |
| 2,488,894 | 11/1949 | Barrett | 81/124.1 |
| 2,493,398 | 1/1950 | Fricke | 81/124.1 |
| 2,543,444 | 2/1951 | Dezorze | 81/124.1 |
| 2,651,229 | 9/1953 | Lenz | 81/124.1 |
| 2,896,489 | 7/1959 | Madsen | 81/124.1 |
| 3,262,338 | 7/1966 | Maholl | 76/114 |
| 4,535,657 | 8/1985 | Farris | 81/124.1 |

FOREIGN PATENT DOCUMENTS

| | | | |
|---|---|---|---|
| 2935999 | 4/1981 | Germany | 81/121.1 |

*Primary Examiner*—Douglas D. Watts
*Attorney, Agent, or Firm*—John H. Crozier

[57] ABSTRACT

In a preferred embodiment, a nut ejecting apparatus for a wrench socket of the type including a generally elongate, hollow, cylindrical body portion having axially aligned nut receiving and shank receiving chambers defined at opposite ends thereof with an intermediate chamber axially aligned with and joining said nut receiving and shank receiving chambers, the nut receiving chamber being dimensioned to receive therein a threaded nut and the shank receiving chamber being dimensioned to receive therein a shank of a wrench, the intermediate chamber being cross-sectionally coextensive with the nut receiving chamber and being hexagonal in cross-section, the nut ejecting apparatus comprising: a first plug to be disposed in the intermediate chamber near the shank receiving chamber and to be positionally fixed therein; a second plug to be disposed in the intermediate chamber and axially moveable back and forth therein and into the nut receiving chamber; the first and second plugs having hexagonally shaped head portions to engage the hexagonal cross-section of the intermediate chamber; and a spring attached to and extending between the first and second plugs to bias the second plug into the nut receiving chamber so as to eject a nut therefrom.

2 Claims, 2 Drawing Sheets

APPARATUS FOR EJECTING NUTS FROM SOCKETS AND A METHOD OF INSTALLATION IN A SOCKET

BACKGROUND OF THE INVENTION

1. Field of the Invention

The present invention relates to tools generally and, more particularly, but not by way of limitation, to a novel apparatus for ejecting nuts from wrench sockets and a method for installing such apparatus in existing wrench sockets.

2. Background Art.

A common problem with using wrench sockets to remove threaded nuts from threaded studs and other threaded members is that the nuts often become stuck in the socket during the removal process. This is especially true when an impact wrench is being used, due to the high forces involved.

A number of attempts have been made to provide devices for ejecting such nuts.

U.S. Pat. No. 1,607,421, issued Nov. 16, 1926, to Work, describes a magazine wrench having a brace attached to one end of an elongate magazine. At the working end of the magazine there is a retainer to keep loose nuts in the magazine from falling out of the working end. A spring extending interiorly of the magazine has one end soldered or otherwise attached to the brace end of the wrench and to a follower at the other end thereof. When the retainer at the working end is released, the nuts are expelled from the magazine.

U.S. Pat. No. 2,301,945, issued Nov. 17, 1942, to Green, describes a socket wrench having a magazine in the handle for the storage of sockets and having leaf springs in the sockets thereof for retaining therein screw-bolts.

U.S. Pat. No. 2,488,894, issued Nov. 22, 1949, to Barrett, describes a socket wrench with a nut ejector. The socket of the wrench has conventional shank receiving and nut receiving portions at opposite ends thereof. Intermediate the shank and nut receiving portions is an axially extending chamber into which a cage is pressed. A spring biased plunger axially moveable within the cage ejects nuts from the nut receiving portion.

U.S. Pat. No. 2,493,398, issued Jan. 3, 1950, to Fricke, describes a magazine-type lug nut wrench similar in pertinent respects to the '421 patent above.

U.S. Pat. No. 2,651,229, issued Sep. 8, 1953, to Lenz, describes a combined socket wrench and nut ejector in which a plunger, extending into a nut receiving portion of the body, and a shank portion are joined by an intermediate stem, all arranged for axial movement within an elongate body member. A coil spring disposed around the stem is compressed between a stop in the body and the inner end of the shank portion so as to urge the plunger into the body member. When a nut is unscrewed and is stuck in the nut receiving portion of the body, the body is manually pulled toward the shank end and the plunger ejects the nut from the body.

U.S. Pat. No. 4,535,657, issued Aug. 20, 1985, to Farris, describes a socket wrench with a nut ejector, the socket being based on a conventional socket and having shank receiving and nut receiving portions at opposite ends thereof with an intermediate bore extending therebetween. A hollow sleeve is fitted within the bore for axial movement with respect thereto and a necked nut ejector formed as an extension of the sleeve is extendable into the nut receiving portion. An internally circumferential groove is cut into the intermediate bore near the nut receiving portion into which groove is installed a C-shaped retainer to prevent the sleeve from exiting the bore. A helical spring disposed internally of the sleeve and extending between the shank portion of the socket and a shoulder formed at the internal end of the necked nut ejector biases the nut ejector into the nut receiving portion to eject nuts therefrom.

None of the above ejecting devices can be easily retrofitted to existing wrench sockets. All of the above devices, except the last, require specially manufactured sockets and the last device requires a specially manufactured socket to the extent that an internal groove must be cut on an engine lathe and some sort of fixture must be used to assist the difficult maneuver of assembling the device and inserting the C-shaped retainer. All are relatively expensive to provide.

Accordingly, it is a principal object of the present invention to provide a nut ejecting apparatus which can easily be easily installed in existing wrench sockets.

It is a further object of the invention to provide such a nut ejecting apparatus which is simple and inexpensive to provide.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a nut ejecting apparatus for a wrench socket of the type including a generally elongate, hollow, cylindrical body portion having axially aligned nut receiving and shank receiving chambers defined at opposite ends thereof with an intermediate chamber axially aligned with and joining said nut receiving and shank receiving chambers, said nut receiving chamber being dimensioned to receive therein a threaded nut and said shank receiving chamber being dimensioned to receive therein a shank of a wrench, said intermediate chamber being cross-sectionally coextensive with said nut receiving chamber and being hexagonal in cross-section, said nut ejecting apparatus comprising: a first plug to be disposed in said intermediate chamber near said shank receiving chamber and to be positionally fixed therein; a second plug to be disposed in said intermediate chamber and axially moveable back and forth therein and into said nut receiving chamber; said first and second plugs having hexagonally shaped head portions to engage said hexagonal cross-section of said intermediate chamber; and a spring attached to and extending between said first and second plugs to bias said second plug into said nut receiving chamber so as to eject a nut therefrom.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
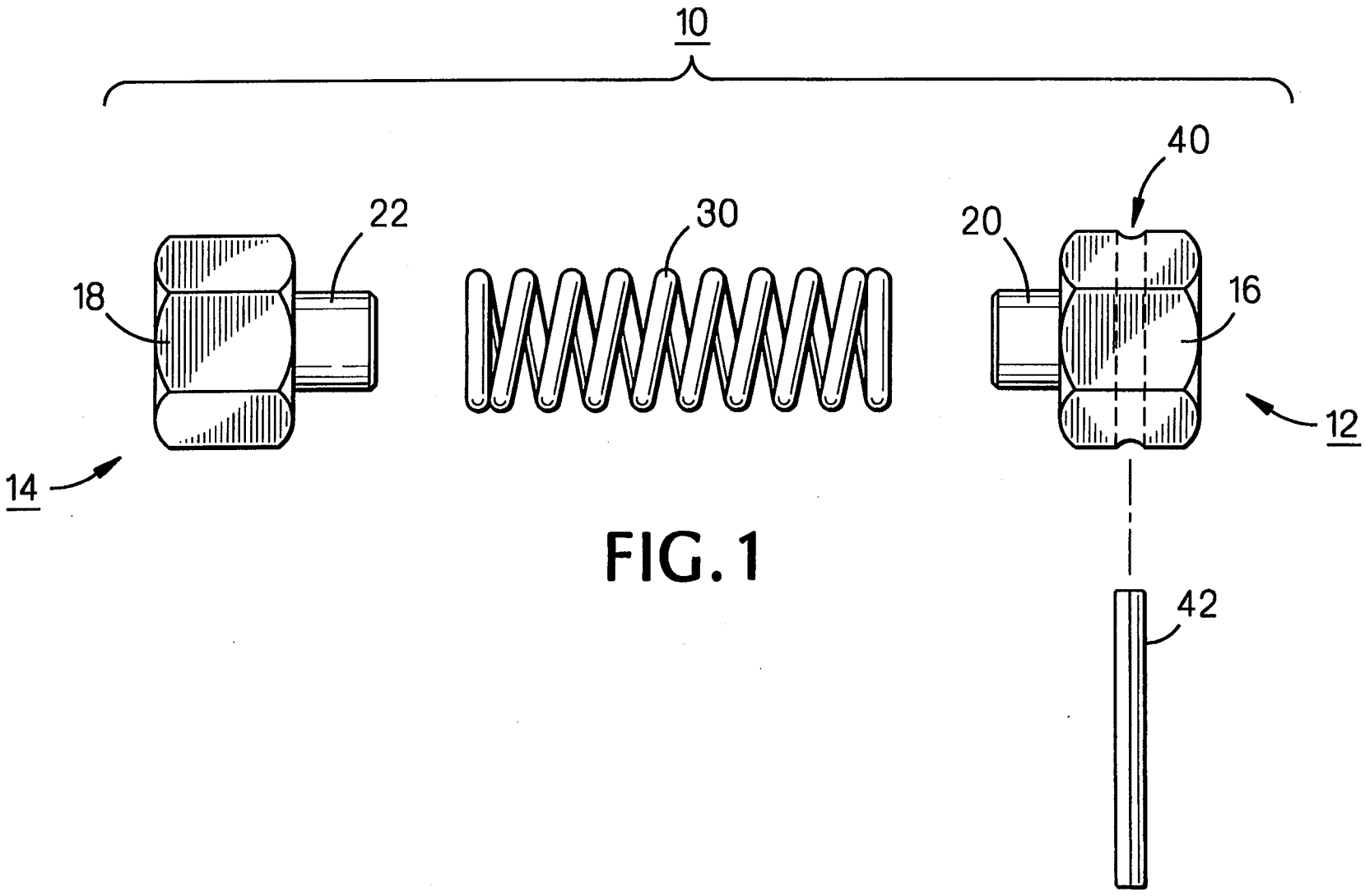
FIG. 1 is side elevational view of the elements of the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Reference should now be made to FIG. 1 wherein are illustrated the elements of a nut ejector apparatus of the present invention, generally indicated by the reference numeral 10. Nut ejector apparatus 10 includes two plugs, generally indicated by the reference numerals 12 and 14, having hexagonally shaped head portions 16 and 18, respectively, and cylindrical stem portions 20 and 22, respectively, formed as axial extensions of the head portions, with the distal ends of the stem portions axially aligned in spaced apart facing relationship.

A helical spring 30 is disposed between plugs 12 and 14 and is dimensioned such that stem portions 20 and 22 may be inserted in the ends of the spring and frictionally retained therein.

A cylindrical channel 40 is defined through plug 12 orthogonally to the major axis thereof and sized to accept therein a roll pin 42.

Figure 2:
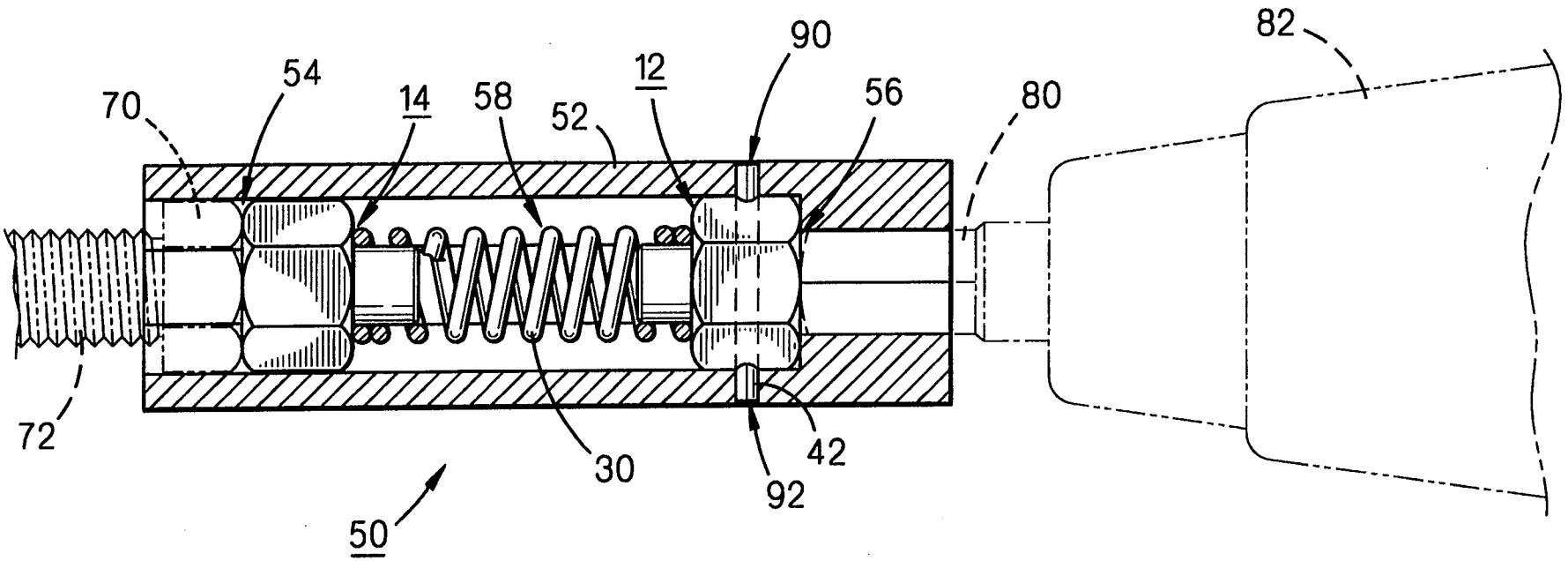
FIG. 2 is a side elevational view, partially in cross-section, of a wrench socket with the elements of the present invention installed therein.

Referring now to FIG. 2, there is illustrated the elements of nut ejecting apparatus 10 illustrated on FIG. 1 assembled and inserted in a conventional wrench socket, generally indicated by the reference numeral 50. Socket 50 includes a generally elongate cylindrical body portion 52 having a nut receiving chamber 54 and a shank receiving chamber 56 defined therein at opposite ends thereof, with an intermediate chamber 58 therein joining the nut receiving and shank receiving chambers.

Nut receiving chamber 54 is hexagonal in cross-section and is dimensioned to receive therein a threaded nut 70 which is threaded on a threaded stud 72. Shank receiving chamber 56 is dimensioned to receive therein a square shank 80 of a wrench 82 which, in this case, may be assumed to be an impact wrench. Intermediate chamber 58 is cross-sectionally coextensive with nut receiving chamber 54 and is also hexagonal in cross-section.

Plug 12 is fixedly disposed in intermediate chamber 58 by means of roll pin 42 having been inserted through channels 90 and 92, drilled through opposite portions of the wall of body 52, and inserted through coaxially aligned channel 40 (FIG. 1) defined through head 16 of plug 12.

To assemble apparatus 10 in socket 50, the assembler forces stems 20 and 22 of plugs 12 and 14 (FIG. 1) into the ends of spring 30, drills channels 90 and 92 through the walls of body 52 (FIG. 2) of the existing socket 50, inserts the plugs attached with spring 30 into intermediate chamber 58, and inserts roll pin 42 through through channels 90, 40, and 92 to secure apparatus 10 in the intermediate chamber.

Referring to FIG. 2, it will be understood that the head of plug 14 is dimensioned to engage and axially move back and forth in intermediate chamber 58 and into nut receiving chamber 54. Spring 30 biases plug 14 into the latter position to eject nut 70 from nut receiving chamber 54 should it become stuck therein. The frictional engagement of spring 30 with stems 20 and 22 (FIG. 1) prevents plug 14 from falling out of socket 50. Having the head of plug 12 also dimensioned to engage and axially move within in intermediate chamber 12 maintains the relative radial orientation of the plug with body 52 during the installation of apparatus 10 in socket 50.

The elements of apparatus 10 may be easily and economically formed of any conventional suitable materials by conventional means. A range of sizes may be furnished installing in a similar range of sizes of existing sockets. The elements of apparatus 10 may be furnished as shown on FIG. 1 or may be furnished already assembled in socket 50 (FIG. 2).

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A method of installing a nut ejection apparatus in an existing conventional wrench socket of the type including a generally elongate, hollow, cylindrical body portion having axially aligned nut receiving and shank receiving chambers defined at opposite ends thereof with an intermediate chamber axially aligned with and joining said nut receiving and shank receiving chambers, said nut receiving chamber being dimensioned to receive therein a threaded nut and said shank receiving chamber being dimensioned to receive therein a shank of a wrench, said intermediate chamber being cross-sectionally coextensive with said nut receiving chamber and being hexagonal in cross-section, comprising:

(a) providing first and second plugs having hexagonally shaped head portions to engage said hexagonal cross-section of said intermediate chamber, said first plug having a channel defined radially through said head portion thereof, and providing a spring attached to and extending between said first and second plugs;

(b) providing a channel defined through opposite wall portions of said intermediate chamber near said shank receiving chamber;

(c) inserting said first and second plugs with said spring attached thereto into said intermediate chamber with said first plug disposed near said shank receiving chamber; and (d) aligning said channel defined through said head portion of said first plug and said channels defined through said wall portions of said intermediate chamber and inserting a pin through all said channels to fixedly position said first plug in said intermediate chamber, such that said second plug is disposed in said intermediate chamber and axially moveable back and forth therein and into said nut receiving chamber so as to eject a nut therefrom.

2. A method, as defined in claim 1, further comprising:

(a) providing said first and second plugs having cylindrical stem portions formed as axial extensions of said head portions, with the distal ends of said stem portions axially aligned in spaced apart facing relationship; and (b) providing said spring as a helical spring dimensioned such that said stem portions can be inserted in the ends of said spring and frictionally retained therein.

* * * * *